United States Patent [19]

Baum

[11] 4,394,218

[45] Jul. 19, 1983

[54] COKE QUENCH CAR EMISSION CONTROL SYSTEM

[75] Inventor: Joerg P. Baum, Hosel, Fed. Rep. of Germany

[73] Assignee: Baumco Gesellshaft fur Anlagentechnick mbH, Essen, Fed. Rep. of Germany

[21] Appl. No.: 338,275

[22] Filed: Jan. 11, 1982

[51] Int. Cl.[3] ..... C10B 33/00; C10B 33/14; C10B 45/00

[52] U.S. Cl. ..... 202/263; 414/212

[58] Field of Search ..... 202/263; 414/209, 212; 266/157–159

[56] References Cited

U.S. PATENT DOCUMENTS

| | | | |
|---|---|---|---|
| 3,869,352 | 3/1975 | Allen et al. | 202/263 |
| 4,113,575 | 9/1978 | Manda et al. | 202/263 |
| 4,186,057 | 1/1980 | Schulte et al. | 202/263 |
| 4,196,053 | 4/1980 | Grohmann | 202/263 |
| 4,196,054 | 4/1980 | Becker | 202/263 |
| 4,213,489 | 7/1980 | Cain | 202/263 |
| 4,213,828 | 7/1980 | Calderon | 202/263 |

*Primary Examiner*—Bradley Garris

*Attorney, Agent, or Firm*—Fred Wiviott

[57] ABSTRACT

A coke quench car emission control system includes a coke car and a filter car connected in tandem for joint movement on rails disposed adjacent a coke oven. A hood and recuperator are mounted on a third car disposed on auxiliary rails which extend longitudinally along the upper portions of both the quench car and the filter car and in end-wise alignment. The hood is adapted to be coupled to the coke oven for receiving coke during a pushing operation. The recuperation has an inlet coupled to the hood for receiving emissions and withdrawing heat therefrom. The recuperator also has an outlet which is disposed adjacent the inlet of a filter system mounted on the filter car, when the third car is positioned atop the quench car. The third car is sized so that it can be moved on the auxiliary rails from a position atop the quench car to a position atop the filter car whereby the quench car can be exposed for a quenching operation.

12 Claims, 4 Drawing Figures

COKE QUENCH CAR EMISSION CONTROL SYSTEM

BACKGROUND OF THE INVENTION

This invention relates to coke quench car pollution control systems, and more particularly to a system which is self-contained.

The manufacture of coke typically involves heating coal in a battery of enclosed oven cells. When the coking process is completed, the coke is pushed sequentially from each cell through a coke guide and into a quench car mounted on tracks adjacent the coke oven. After loading, the car is transported to a coke quencher which may, for example, take the form of a quenching tower where the coke is cooled by spraying it with water.

Numerous systems have been devised for capturing emissions which occur during the coke pushing operation. One such prior art system includes the hood positionable over the quench car and having an inlet adapted to be coupled to the coke guide. One common type of gas cleaning apparatus for such prior art systems generally includes an elongate duct in general parallelism to the coke ovens and disposed on the opposite side of the quench car tracks. In order to couple the movable quench car hood to the stationary gas collecting duct, a flexible coupling was required. In one such system the upper portion of the duct is closed by an elongate flexible belt and the quench car outlet is adapted to elevate a short section of the belt and couple to the open upper portion of the duct as the quench car moves therealong. In this manner, a sliding coupling was provided between the quench car and the stationary duct.

These types of prior art coke car emission collection systems were relatively expensive to install and did not lend themselves to being retro-fitted into existing coke oven systems because a substantial amount of space was required to accommodate the elongate duct.

SUMMARY OF THE INVENTION

It is an object of the invention to provide a new and improved emission collection system for coke quench cars.

Another object of the invention is to provide a quench car emission collection system which is self-contained and does not require fixed installations.

A still further object of the invention is to provide a coke quench car emission control system which can readily be installed in existing coke producing installations.

These and other objects and advantages of the present invention will become more apparent from the detailed description thereof taken with the accompanying drawings.

In general terms, the invention comprises car means having a coke quenching section and a second section which includes filter means. Rail means are mounted at the upper portions of the car means and extend longitudinal over the coke quenching section and the second section. A transporter is mounted atop the rails and is adapted to move from a first position wherein it is disposed over the coke quenching section to a second position atop the second section wherein the coke quenching section is uncovered. An emission collecting hood is mounted on the transporter and is adapted when in its first position to be coupled to a coke oven for receiving coke during a pushing operation and for passing the same to the coke quenching section while collecting emissions therefrom. The hood means also has an outlet disposed proximate to an inlet of the filter means when the transporter is in its first position whereby particulate matter in the emissions may be removed.

DESCRIPTION OF THE PREFERRED EMBODIMENT

Figure 1:
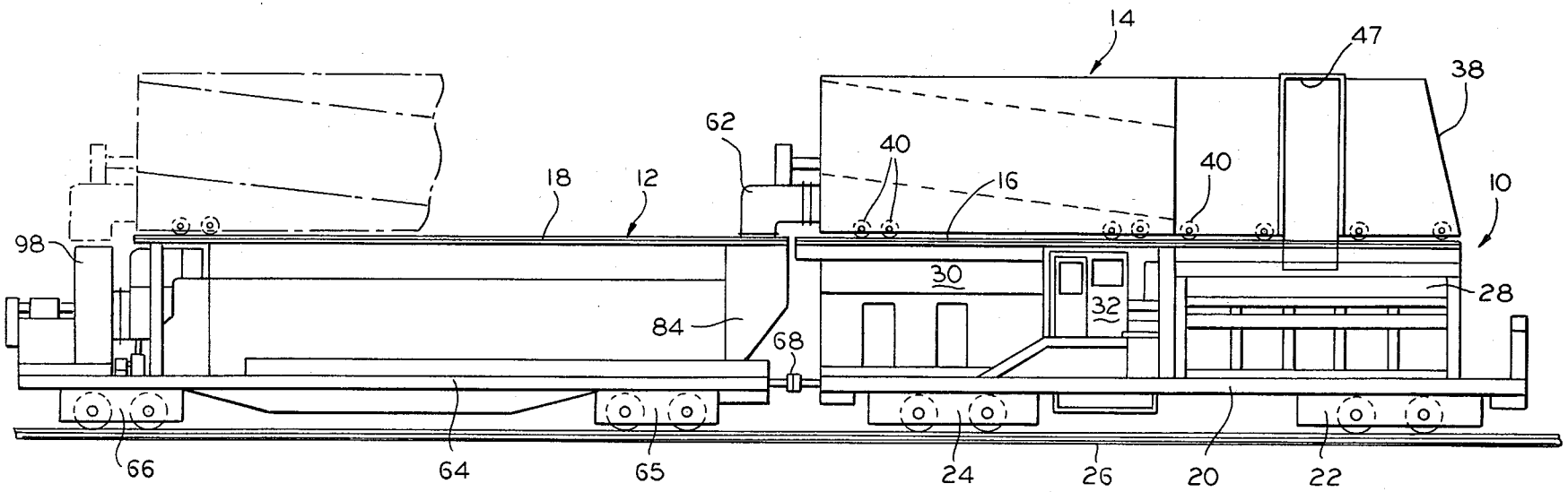
FIG. 1 is a side elevational view showing a coke quench car system according to the preferred embodiment of the invention.

FIG. 1 shows the preferred embodiment of the invention to include a coke quench car 10, a filter car 12 and a hood car 14. Pairs of parallel rails 16 and 18 are mounted longitudinally on the upper portions of the coke quench car 10 and the filter car 12 and are disposed in end-wise alignment relative to each other. The hood car 14 is mounted on the rails 16 and 18 for movement from the position on car 10 shown by full lines in FIG. 1 to its position shown by full lines in FIG. 2.

Figures 3A, 3B:
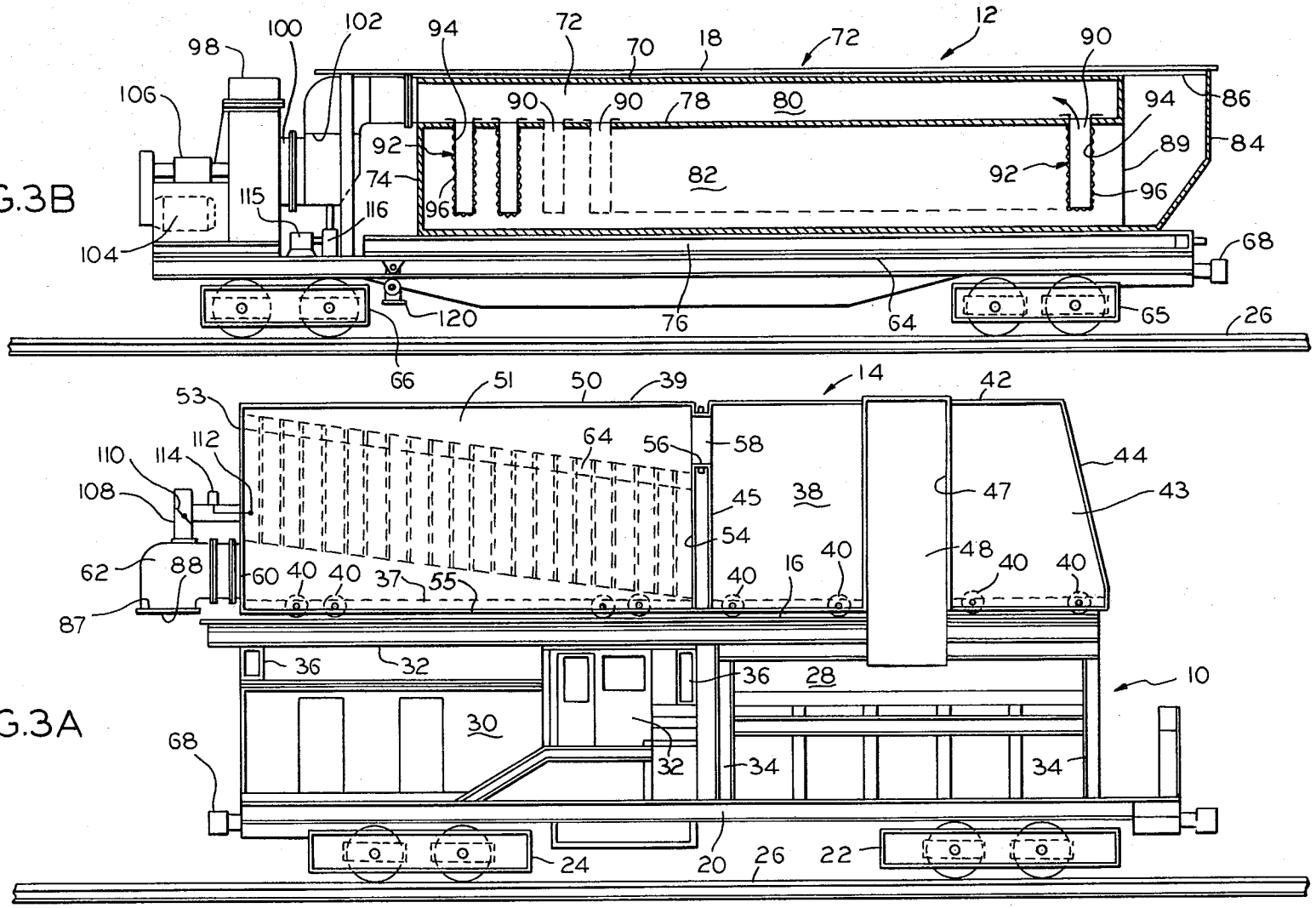
FIGS. 3A and 3B show the components of the coke quench car system of FIG. 1 in greater detail.

The coke quench car 10 is generally conventional and is shown in FIG. 3A to include a rectangular frame 20 which is mounted upon spaced-apart trucks 22 and 24 disposed on rails 26 extending adjacent a coke oven (not shown). A coke containing compartment 28 is mounted adjacent one end of frame 20 and is open at it upper end for receiving coke as it is pushed from the oven. Adjacent the coke compartment 28 is an engine 30 and a cab 32. The engine is coupled to the truck 24 in a conventional manner for moving the car 10 along the rails 26 and between the coke oven and a quench tower, neither of which are shown but both of which are well-known in the art.

A second generally rectangular frame 32 is supported above the car 10 in general parallelism with frame 20 by means of a first plurality of vertical supports 34 which extend upwardly from frame 20 adjacent the corners of coke containing compartment 28 and a second plurality of vertical supports 36 which extend upwardly from the engine 30 and cab 32. The rails 16 are mounted atop the second frame 32 for supporting the hood car 14.

A hood 38 and a recuperator 39 are mounted on hood car 14 and are endwise coupled. The hood 38 has a top wall 42, side walls 43 and end walls 44 and 45 which define an enclosure that is open at its lower end and is sized to overlay the open upper end of the coke receiving compartment 28. A rectangular opening 47 having a door 48 is provided in one-side 43 of hood 38 and is adapted to be coupled to a coke guide (not shown) so that coke being pushed from an oven will pass through opening 47 and fall into the coke containing compartment 28. The door 48 normally covers the opening 47 but is mounted for being displaced when the opening is coupled to the coke guide (not shown). The door 48, the coke guide, the oven and the pushing apparatus are all well known in the art and will not be discussed in detail for the sake of brevity.

The hood car 14 is shown in FIG. 3A to include a rectangular frame 37 which supports a hood 38 and the recuperator 39. A plurality of wheels 40 are journaled on frame 37 and engage the rails 16 for longitudinal movement of car 14 from its position shown by full lines in FIG. 1 which it is atop the car 10 to a position shown by full lines in FIG. 2 where it is located on rails 18 atop car 12, as will be discussed more fully herein below. A suitable drive motor (not shown) is coupled to at least some of the wheels 40 for driving the car 14 between its alternate positions.

The recuperator 39 includes a top wall 50, side walls 51, end walls 53 and 54 and a floor 55. An inlet opening 56 is formed adjacent the upper end of wall 54 and coupled to an outlet opening 58 in the wall 45 of hood 38. In addition, an outlet 60 is formed adjacent the lower end of wall 53 and is coupled to an elbow 62 which is adapted to communicate with the inlet of filter 12 as will be discussed more fully below. A heat sink 64 is disposed within recuperator 39 and extends generally diagonally from wall 54 below inlet 56 to wall 53 above outlet 60. As those skilled in the art will appreciate, the heat sink consists of a metallic grillwork having a plurality of vertical passages which permits the flow of emissions downwardly therethrough. The heat sink 64 has sufficient mass to absorb heat from the emissions thereby lowering the temperature thereof. The absorbed heat is then dissipated through the recuperator, by the cold air which is drawn through it after the pushing operation is over. In this way the recuperator is then ready for the next pushing operation.

Filter car 12 is shown in FIG. 3B to also include a rectangular frame 64 having a pair of trucks 65 and 66 which also are supported on rails 26. A suitable coupling 68 connects filter car 12 to the hood car 10 so that the two will be moved in tandem by the operation of engine 30.

The filter 12 may be of any suitable type, although, a bag type filter is illustrated. More particularly, filter 12 includes an enclosure defined by a top wall 70, side wall 72, end wall 74 and a bottom dust collector 76. A partition 78 extends horizontally across the enclosure to divide the same into upper and lower chambers 80 and 82. The other end of the enclosure is defined by an inlet chute 84 having an upwardly oriented inlet opening 86 which is complementary to the outlet of elbow 62 and is oriented to be disposed in close proximity thereto when the car 14 is disposed in its position shown by full lines in FIG. 1. In addition, chute 84 has an outlet opening 89 which opens into chamber 82 whereby emissions passing from the recuperator 39 and through elbow 62 will be delivered below partition 78.

A plurality of circular holes 90 are formed in the partition 78 for respectively receiving a filter element 92 which may, for example, comprise a metallic frame 94 whose outer margin is covered by a filter bag 96 formed of any suitable material such as fiberglass felt. A suitable suction fan 98 is also mounted on car 12 and has an inlet 100 coupled by conduit 102 to the compartment 80 on the side of the car opposite inlet chute 84. The fan 98 may be of any suitable type and is driven by a drive motor 104 and a gear reducer 106.

In operation, car 14 as shown in FIGS. 1 and 3A is initially disposed over the car 10 and the latter positioned adjacent a coke oven. The engine 30 is then operated to sequentially position the opening 47 of hood 36 adjacent individual cells of the coke oven and coke is pushed through a coke guide into the coke receiving compartment 28. In the meantime, fan 98 is actuated so that emissions collected in the hood are drawn through the opening 58 and into the recuperator 39, passed downwardly through the heat sink 64 and through the duct 62 into the filter 12. The passage of gases through the recouperator will result in a loss of heat and a consequent temperature reduction. However, in order to further insure that the temperature of the gases and particulate material entering filter 80 are not inordinately high, and air intake 108 is coupled to the elbow 62 and has a damper 110 operable under the control of a temperature probe 112 disposed within the recuperator chamber 39. The temperature probe 112 is coupled to a control 114 which adjusts damper 110 so that sufficient cooler outside air will be provided so as to maintain temperatures within acceptable limits.

The emissions enter filter 12 through inlet 89 and pass inwardly through the bag filters 96 to the upper chamber 80. Particulate material will collect from the outside of the bags 96 as the gases are exhausted through fan outlet 98. The bags 96 may be periodically cleaned in any conventional manner such as by means of a motor 115 and compressor 116 which are coupled to the conduit 102 which leads to individual injection pipes (not shown) located over each row of bags. The injection pipes have nozzles (not shown) which are located on the center line of each bag outlet. Whenever necessary the motor 115 can be actuated and will drive an air compressor to establish the necessary air pressure in the conduit 102. Solenoid valves (not shown) open alternatively the passage to each injection pipe to provide a pulsing back pressure to the inside of the bag cages 94. This causes the bags 96 to balloon outwardly whereby the dust will be dislodged and fall onto the bottom of filter 12 from where it is conveyed by a chain conveyor (not shown) to the dust outlet 120. The dust can be removed in any suitable manner such as by a pneumatic dust collecting method which is well known in the art.

Figure 2:
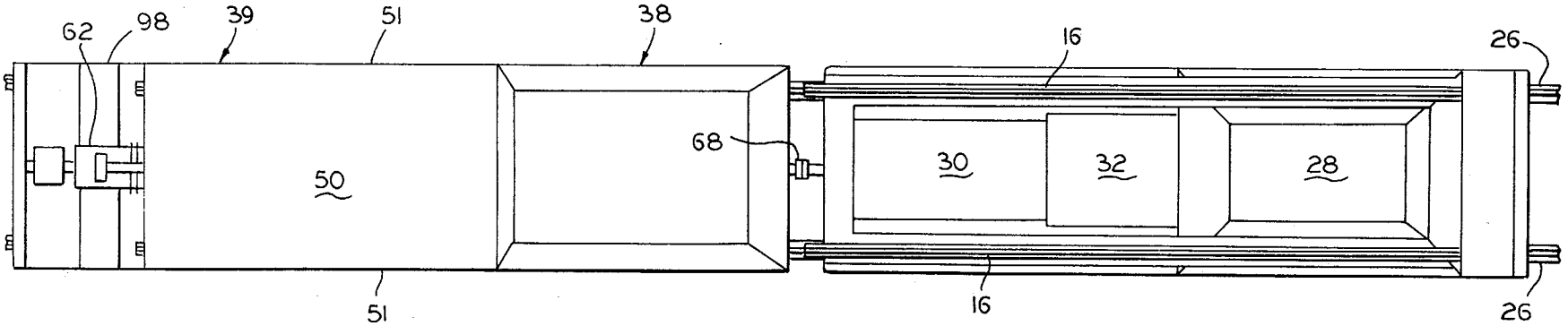
FIG. 2 is a top plan view of the quench car system shown in FIG. 1 with a portion thereof in an altenate position.

After the desired amount of coke has been collected in the coke receiver 28, the engine 30 is operated to transport the cars 10 and 12 to the coke quench tower. Simultaneously, the car 14 is transported on rails 16 and 18 and to the left as shown in FIG. 1 until it is positioned over the car 12 as seen in FIG. 2 and FIG. 3B. This will expose the open upper end of the coke receptacle 28 so that it may be disposed within the quench tower for a quenching operation.

Only a single embodiment of the invention has been illustrated and described, it is not intended to be limited thereby but only by the scope of the appended claims.

I claim:

1. A system for capturing emissions from coke as it is pushed from an oven including:

a first transporter movable in a path adjacent said oven, coke receiving means and gas cleaning means mounted adjacent each other on said first transporter, guide means mounted on said first transporter and extending over said coke receiving means and said gas cleaning means, a second transporter mounted on said guide means and movable thereon from a first position above said coke receiving means to a second position above said gas cleaning means, said second transporter having hood means mounted thereon, said coke receiving means being open at its upper end for receiving coke, said hood means being open at its lower end and sized to cover the opening in said coke receiving means, said hood means also having a port for receiving coke from a coke oven, and coupling means for coupling said hood means to said gas cleaning means when said second transporter is positioned above said coke receiving means whereby emissions collected by said hood means are transmitted to said gas cleaning means, the opening in said coke receiving means being exposed when said second transporter is in its second position to permit the coke and in said coke receiving means to be quenched.

2. The system set forth in claim 1 wherein said hood means includes a hood and recuperator means for removing heat from said emissions.

3. The system set forth in claim 2 wherein said recuperator means includes a metallic mass having a plurality of vertical passages formed therein.

4. The system set forth in claim 3 wherein said first transporter includes a first car and a second car coupled to said first car, said coke receiving means being mounted on said first car and said gas cleaning means being mounted on said second car, and motive means being mounted on one of said cars.

5. The system set forth in claim 4 wherein said gas cleaning means includes filter means having an inlet and suction means.

6. The system set forth in claim 5 including temperature control means coupled to the inlet of said filter means for controlling the temperature emissions passing into said gas cleaning means.

7. A system for capturing emissions from coke as it is pushed from an oven including:

first car means movable in a path adjacent said oven, coke receiving means and gas cleaning means mounted adjacent each other on said first car means, track means mounted on said car means and extending over said coke receiving means and said gas cleaning means, second car means mounted on said track means and movable thereon from a first position above said coke receiving means to a second position above said gas cleaning means, said second car means having hood means mounted thereon, said coke receiving means being open at its upper end for receiving coke, said hood means being open at its lower end and sized to cover the opening in said coke receiving means, said hood means also having a port in one side thereof for receiving coke from a coke oven, said gas cleaning means having an inlet, said hood means having an outlet positioned adjacent said inlet when said second car means is positioned above said coke receiving means whereby emissions collected by said hood means are transmitted to said gas cleaning means, the opening in said coke receiving means being exposed when said second car means is in its second position to pemit the coke in said coke receving means to be quenched.

8. The system set forth in claim 7 wherein said hood means includes a hood and recuperator means for removing heat from said emissions, said hood having an outlet, said recuperator means having an inlet connected to the outlet of said hood and an outlet which is disposed adjacent the inlet of the gas cleaning means when said hood means is disposed above said coke receiving means.

9. The system set forth in claim 8 wherein said recuperator means includes a metallic mass having a plurality of vertical passages formed therein, the inlet of said recuperator means being disposed above said mass and the outlet being disposed therebelow whereby said emissions pass vertically through said mass.

10. The system set forth in claim 9 wherein said first car means includes a first car and a second car coupled to said first car, said coke receiving means being mounted on said first car and said gas cleaning means being mounted on said second car, and motive means being mounted on one of said cars.

11. The system set forth in claim 10 wherein said gas cleaning means includes filter means and suction means, said filter means having an inlet and being disposed between the inlet of said gas cleaning means and said suction means.

12. The system set forth in claim 11 including temperature control means coupled to the inlet of said filter means for controlling the temperature of emissions passing into said gas cleaning means.

* * * * *